US009557714B2

(12) United States Patent
Gruenig et al.

(10) Patent No.: US 9,557,714 B2
(45) Date of Patent: Jan. 31, 2017

(54) TIMEPIECE MOVEMENT INCLUDING AN ANALOGUE DISPLAY DRIVE DEVICE

(71) Applicant: ETA SA Manufacture Horlogere Suisse, Grenchen (CH)

(72) Inventors: Daniel Gruenig, Sugiez (CH); David Benjamin Kraehenbuehl, Bettlach (CH); Pascal Winkler, St-Blaise (CH); Thierry Altenhoven, Zollikofen (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/069,087

(22) Filed: Mar. 14, 2016

(65) Prior Publication Data

US 2016/0274542 A1 Sep. 22, 2016

(30) Foreign Application Priority Data

Mar. 19, 2015 (EP) ..... 15159776

(51) Int. Cl.
*G04B 19/25* (2006.01)
*G04B 13/00* (2006.01)
(Continued)

(52) U.S. Cl.
CPC ..... *G04B 19/253* (2013.01); *G04B 13/001* (2013.01); *G04B 13/002* (2013.01); *G04C 17/005* (2013.01); *G04C 17/0066* (2013.01)

(58) Field of Classification Search
CPC ... G04B 13/001; G04B 13/002; G04B 19/247; G04B 19/253; G04B 19/25333; G04B 19/25353; G04C 17/005; G04C 17/0058
See application file for complete search history.

(56) References Cited

U.S. PATENT DOCUMENTS 3,220,174 A 11/1965 Cappellari
3,704,583 A 12/1972 Dome
(Continued)

FOREIGN PATENT DOCUMENTS

CH 269164 6/1967
CH 446 203 3/1968
(Continued)

OTHER PUBLICATIONS

European Search Report issued Jan. 7, 2016 in European Application 15159776, filed on Mar. 19, 2015 ( with English Translation and Written Opinion).

*Primary Examiner* — Vit W Miska
(74) *Attorney, Agent, or Firm* — Oblon, McClelland, Maier & Neustadt, L.L.P.

(57) ABSTRACT

Timepiece movement including a date display drive device formed of a display disc including a toothing, said drive device including driving means and a drive source. The driving means includes a wheel set including pins, having a toothed wheel and a pinion including pins, and an engaging wheel engaging said toothed wheel. The pinion with pins includes a pair of pins configured to be positioned on either side of any tooth of the toothing. The toothed wheel of the pin wheel and the engaging wheel respectively have complementary non-circular profiles. When the two pins are oriented in a tangential direction to the toothing, these two wheels have a first gear ratio that is lower than a second gear ratio between them when the two pins are in perpendicular alignment to said tangential direction.

15 Claims, 3 Drawing Sheets

(51) Int. Cl.
*G04C 17/00* (2006.01)
*G04B 19/253* (2006.01)

(56) References Cited

U.S. PATENT DOCUMENTS 3,738,097 A * 6/1973 Vuilleumier ..... G04B 19/25366
368/37
4,060,977 A * 12/1977 Rochat ..... G04B 19/25
368/35
4,171,610 A * 10/1979 Gilomen ..... G04B 19/25386
368/38
4,671,670 A 6/1987 Kroner

FOREIGN PATENT DOCUMENTS

| | | |
|---|---|---|
| CH | 498 442 | 3/1970 |
| CH | 172271 | 1/1973 |
| CH | 538 136 | 7/1973 |
| CN | 201611430 U | 10/2010 |

* cited by examiner

TIMEPIECE MOVEMENT INCLUDING AN ANALOGUE DISPLAY DRIVE DEVICE

This application claims priority from European Patent Application No. 15159776.2 filed Mar. 19, 2015, the entire disclosure of which is hereby incorporated herein by reference.

FIELD OF THE INVENTION

The present invention concerns a timepiece movement including an analogue display drive device, particularly for a calendar display.

The present invention also concerns a timepiece movement comprising a device for driving two independent analogue indicators by the same single drive source, in particular an electromagnetic motor.

SUMMARY OF THE INVENTION

It is an object of the invention to provide a device for driving an analogue display, in particular a date ring in a timepiece movement, which is shock resistant most of the time.

It is another object of the invention to provide a drive device for a multifunction analogue display having a single drive source, in particular for driving a date ring and a chronograph hand driver by means of a single motor, which is efficient for each function of the display and which allows for independent actuation of at least one function relative to a second function of the display.

It is advantageous to provide a display drive device for a timepiece movement which is economical to produce.

It is advantageous to provide a display drive device for a timepiece movement which is compact.

Objects of the invention are achieved by a timepiece movement comprising an analogue display drive device according to claim 1. The dependent claims describe advantageous aspects of the invention.

In the present invention, a timepiece movement comprises an analogue display drive device including a display disc comprising a toothing, a drive source and driving means coupling the drive source to the toothing. The driving means includes a wheel set including pins, formed of a toothed wheel and a pinion including pins, and an engaging wheel that engages said toothed wheel of the pin wheel set. The pinion with pins includes two diametrically opposite pins separated by a distance configured to position them on either side of any tooth of said toothing. The toothed wheel has a first non-circular profile and the engaging wheel has a second non-circular profile which is complementary to the first non-circular profile, the toothed wheel and the engaging wheel being arranged with respect to each other such that, when the two pins are oriented in a tangential direction to the toothing, these two wheels have a first gear ratio which is lower than a second gear ratio between said wheels when the two pins are in perpendicular alignment to this tangential direction.

According to a preferred embodiment, when the two pins are oriented tangentially to the display disc toothing, these two pins are arranged to define a self-locking system if a shock exerts a tangential force on the toothing.

A "non-circular profile of a wheel" means a wheel having a toothing that follows a general curve other than a circle, or a wheel having a toothing substantially following a general circle but whose axis of rotation is not at the centre of the general circle. According to a particular embodiment, the non-circular profile of the toothed wheel of the pin wheel set is elliptical or essentially elliptical.

According to a particular embodiment of the invention, the pin pinion is configured, with respect to the display disc toothing, to have a dead angle area for driving the display disc. The angular distance of the dead angle area is arranged to be greater than ten degrees. According to a preferred variant, in the event of a shock, the two pins of the pin pinion block the rotation of the display disc when the angular position of the pin pinion is inside the dead angle area.

According to a main embodiment, the gear reduction ratio between the engaging wheel and the pin wheel is greater inside the aforementioned dead angle area than outside said area.

According to an advantageous embodiment, at least one of the wheels of the driver includes an additional display element; the additional display element can operate in the dead angle area independently of the aforementioned display disc.

According to one embodiment, the additional display wheel is configured to effect a rotation of at least 360° when the pin pinion makes an angular motion inside the dead angle area. The additional display element may, for example, be a hand mounted on an arbor of the additional display wheel. In a particular variant, the additional display wheel is a chronograph wheel.

In one embodiment, the drive source includes an electric motor controlled by an electronic unit of the timepiece movement. The motor may be bidirectional.

Other advantageous objects and aspects of the invention will appear upon reading the claims, and the detailed description of embodiments below.

BRIEF DESCRIPTION OF THE DRAWINGS

The following detailed description is made with reference to the annexed drawings, given by way of non-limiting example, and in which.

DETAILED DESCRIPTION OF THE INVENTION

Figure 1:
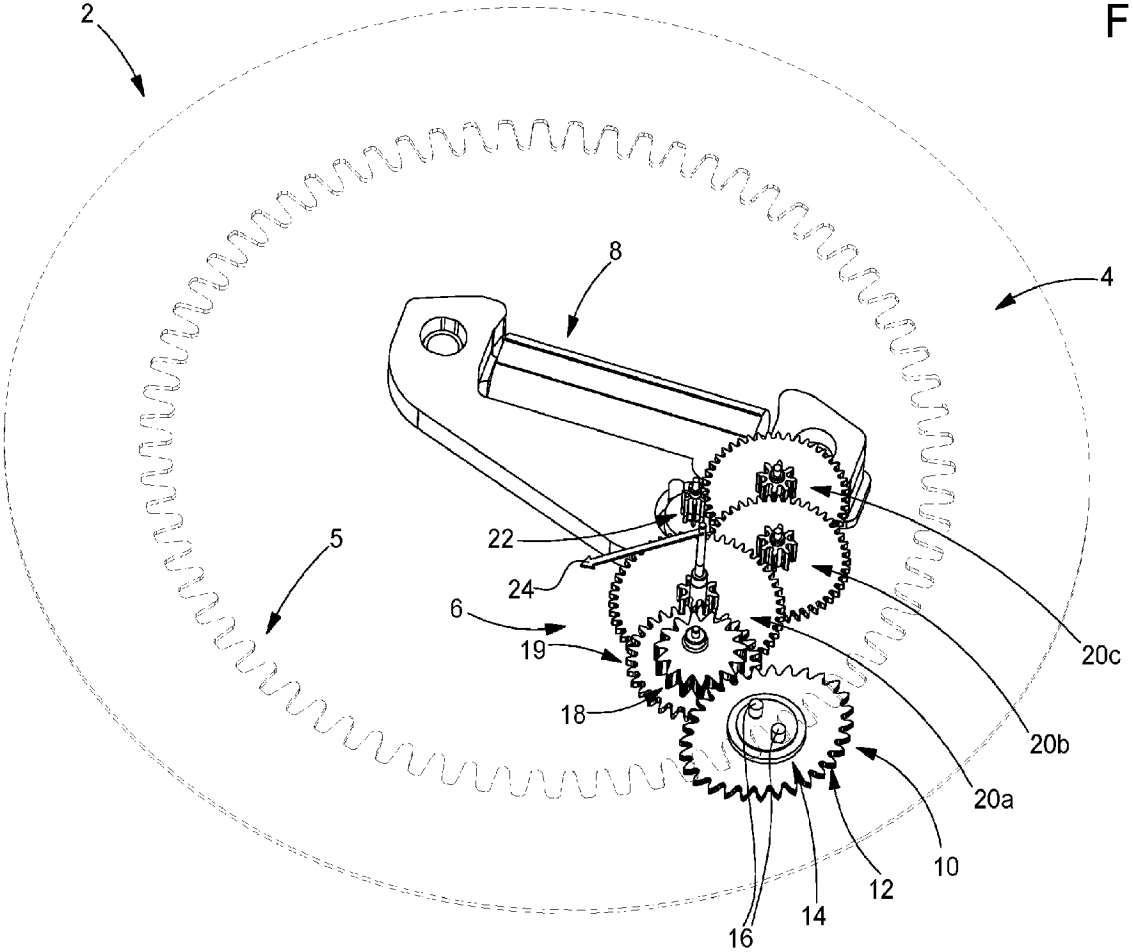
FIG. 1 is a schematic perspective view of a display drive device for a timepiece movement, according to one embodiment of the invention, this Figure illustrating a date disc moving from one stop position to the next stop position.

With reference to the Figures, a timepiece movement 2 comprises a display drive device according to one embodiment of the invention. This display is formed by a display disc 4 and the drive device includes a driving means 6 and a drive source 8. Drive source 8 may, for example, comprise an electric motor controlled by an electronic unit (not illustrated) of an electronic timepiece movement. Within the invention, drive source 8 may also include a mechanical energy source driving a mechanical motor, or a hybrid system. The invention is especially useful for a drive source 8 comprising an electric motor whose idle torque is relatively low and wherein a mechanism for blocking driving means 6 is necessary in the event of a shock. In the illustrated embodiment, the electric motor includes an output pinion 22 coupled to a train of wheels 20*c*, 20*b*, 20*a* of driving means 6. The train of wheels 20*c*, 20*b*, 20*a* is coupled to display disc 4 by means of a pin wheel set 10 and an engaging wheel 18 of the pin wheel set. Engaging wheel 18 is fixedly mounted on another toothed wheel 19 coupled to train of wheels 20*a*, 20*b*, 20*c*.

In the illustrated embodiment, display disc 4 takes the form of a ring comprising a toothing 5 on the inner periphery of the ring; toothing 5 engages pin wheel set 10. In a variant (not illustrated), toothing 5 could be disposed on the outer periphery of the display disc which could take the form either of a solid disc or a ring. In a variant (not illustrated), the display disc could be a segment of a ring or disc; in such case the display device is bidirectional. In one embodiment, the display disc is a date display disc, namely a disc indicating the date (day of the month). Within the invention, in other embodiments, the display disc could be used to display any other non-continuous function, such as, for example the following functions: "AM/PM", "CHR" for chronograph; "GMT"; "TMR" for timer; "AL On/AL Off" for turning an alarm on/off.

Pin wheel 10 includes a toothed wheel 12 with a non-circular profile 13*a*, and a pin pinion 14 comprising pins 16, notably a pair of pins 16*a*, 16*b*. Pin pinion 14 may, for example, take the form of a pair of cylindrical pins disposed on either side of the axis of rotation $A_{10}$ of toothed wheel 12 and directly secured to the toothed wheel or to a plate or disc mounted on toothed wheel 12. The pins may also directly form part of toothed wheel 12, for example by injection moulding, shaping or machining the pins in one-piece with toothed wheel 12.

Figure 2:
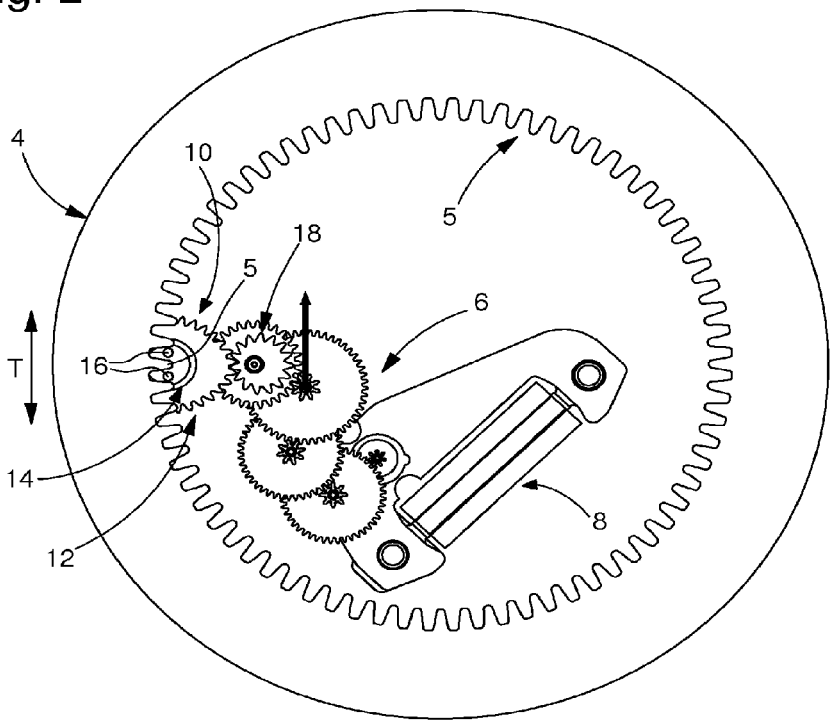
FIG. 2 is a corresponding plan view of the embodiment of FIG. 1, but with the date disc in a stop position, namely a rest or non-driving position.
Figure 3A:
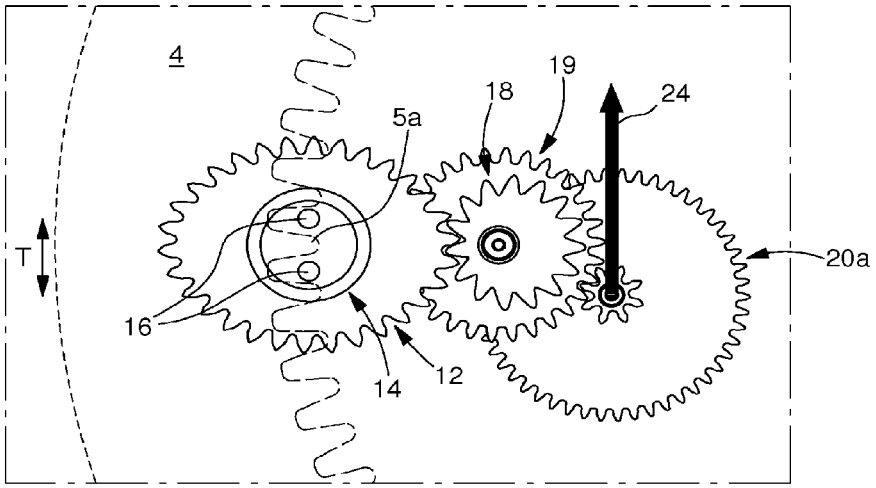
FIG. 3A is a view illustrating a partial enlargement of FIG. 2.

In a stop position as illustrated in FIGS. 2 and 3*a*, pins 16*a* 16*b* are configured to be disposed on either side of any tooth 5*a* of the display disc. In the stop position, the pins block the rotation of display disc 4. Indeed, in this position, the pair of pins 16 is essentially oriented such that a line passing through the pins and axis of rotation $A_{10}$ of pin wheel 10 corresponds to a tangential direction T to the direction of rotation of the display disc on the engaged tooth, in other words to a tangential direction to the general circle defined by toothing 5 at a point corresponding to tooth 5*a*. The distance $d_{16}$ separating the pair of pins 16*a*, 16*b* corresponds to the thickness $d_5$ of a tooth 5*a* plus some play allowing the pair of pins to pivot about a tooth so that the axis of rotation $A_{10}$ of the pin pinion can be located at a certain depth with respect to the free end 21 of tooth 5*a*. This allows pins 16*a*, 16*b* to be positioned on either side of tooth 5*a* and to undergo a rotation between two limit angles +/− α with respect to tangential direction T, the angular distance between these two limit angles −α and +α forming a dead angle area for driving the display disc, i.e. an angular area where the pin wheel does not drive the date disc. In particular, the pin pinion is configured with respect to the display disc toothing so that there is a dead angle area (+/−α) for driving the display disc that is greater than a conventional gear backlash. The angular distance of the dead angle area is generally greater than or substantially equal to ten degrees ($5° < |\alpha|$).

Figure 3B:
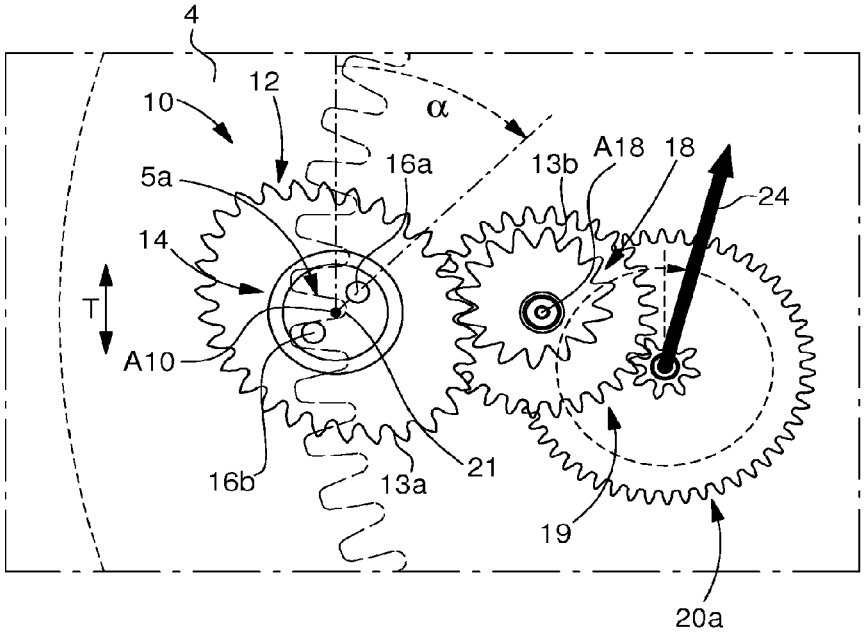
FIG. 3B is a similar view to FIG. 3A but showing the drive device in a dead angle area limit position in which the date disc remains stationary.
Figure 3C:
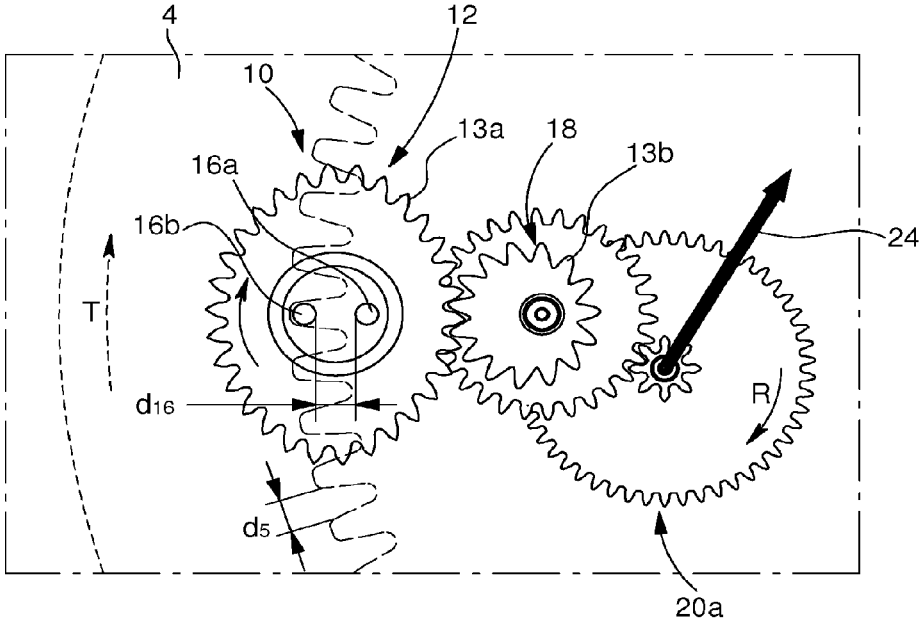
FIG. 3C is a similar view to FIG. 3A but showing the position of FIG. 1 where the date disc is in motion from one stop position to the next stop position.

The distance between the pins, the dimensions of the tooth and the position of the rotational axis of the pin pinion are preferably configured so that the absolute value of the two limit angles +/−α with respect to tangential direction T starts above a maximum ordinary gear backlash angle in a gear train (around 5° in unfavourable cases) to extend, in a preferred variant, roughly to the end of the self-locking area allowing the disc to be blocked in the event of a shock (notably between +/−10° and +/−20° depending on the drive mechanisms). The dead area may, however, extend beyond this limit depending on the embodiment variants. Thus, this angular distance may be greater than 40°. In the example shown in FIG. 3B, the angular distance is substantially equal to 90° (+/−45°). However, in a particular embodiment, with an additional function that will be described below, it is possible to deliberately limit the utilisation of the dead area to the angular locking area for the pin wheel. In this angular locking area, when a rotational force is applied to display disc 4, for example an inertial force due to a shock, tooth 5*a* engages one or other of pins 16*a* 16*b*, which blocks the rotation of the display disc with respect to driving means 6. According to two particular modes, it is possible to use the dead angle area between limit angles −α and +α or the angular locking area (given that the angular distance of the latter is smaller than or equal to that of the dead angle area) for other additional functions, for example a chronograph function, since display disc 4 remains in its stop position between limit angles −α and +α.

In the illustrated example, the additional function may be performed by one or more hands 24 mounted on one or more arbors of wheels 20*a*, 20*b*, 20*c* of the wheel train coupling drive source 8 to pin wheel 10. In the illustrated example, one of the wheels is a chronograph wheel 20*a* with an arbor on which chronograph hand 24 is mounted, the gear reduction ratio between this wheel and pin pinion 14 being such that, when the wheel effects one revolution, the pin pinion effects at most a rotation of angle a corresponding to half the angular distance of dead angle area +/−α. In this chronograph function, when chronograph hand 24 has effected one revolution, it is returned back by the electric motor so that counting can continue without thereby changing the position of display disc 4. The chronograph wheel can be used, for example, to indicate the seconds, minutes or hours. In the dead angle area from −α to +α, it is therefore possible to use the wheels of wheel train 20*a*, 20*b*, 20*c* coupled to drive source 8 for any desired function without thereby disrupting the display of display disc 4; which makes it possible to reduce the number of motors required in the timepiece movement for the various desired functions. Of course, depending on the desired reduction ratios and display, it would be possible to use a different wheel of the train from that used in the illustrated example, or an additional wheel, in a meshed relationship with one of the wheels of the wheel train, for the desired function.

According to one aspect of the invention, toothed wheel 12 of pin wheel set 10 and the pin wheel engaging wheel 18, have non-circular profiles 13*a*, 13*b*, configured for slower angular rotation in the dead angle area than in the active area (outside the dead angle area). This makes fast display transition possible outside the dead angle area. A first advantage is that this allows for a fast change of position of display disc 4 and notably minimises the time interval during which pin pinion 14 is outside an angular area where the pin pinion is not guaranteed to block display disc 4 in the event of a shock or other inertial torques applied to the display disc with respect to driving means 6.

Further, the configuration in the embodiment shown makes it possible to have a greater gear reduction ratio between engaging wheel 18 and pin wheel 10 inside the dead angle area than in the active area (outside the dead angle area). This makes it possible to reduce the gear reduction ratio required in the driver to obtain a complete rotation of chronograph wheel 20*a* while remaining comfortably inside the dead angle area −/+α. In a preferred embodiment, the additional display wheel 20*a* is configured to be able to effect a rotation of at least 360° during an angular motion inside the dead angle area. In the invention, for the minimum given drive torque necessary to drive the display disc by the pin pinion, an angular area is obtained on wheel 20*a* corresponding to the dead angle area of the pin wheel set, which is larger than in the case of circular wheels with central axes of rotation. For one rotation of limit angle a of the dead angle area of pin pinion 14, the maximum angular distance travelled by wheel 20*a* associated with an additional indicator 24 is obtained by means of a maximum speed increaser gearing between pin pinion 14 and wheel 20*a*, and thus a maximum gear reduction in the opposite direction. In the dead angle area around the tangential position of the two pins 16*a*, 16*b*, there is thus a large gear reduction between wheel 20*a* and pin pinion 14. Thus, wheel 20*a* can effect a rotation over a relatively large angular range without display disc 4 moving significantly.

In one embodiment, the non-circular profile 13*a* of toothed wheel 12 may, for example, have an elliptical or essentially elliptical shape; the non-circular profile 13*b* of pin wheel engaging wheel 18 is then complementary. The non-circular profile 13*b* of pin wheel engaging wheel 18 is off-centre in the illustrated example with respect to the axis of rotation $A_{18}$ of said wheel. Engaging wheel 18 thus effects two revolutions for each revolution of pin wheel set 10. The teeth profiles may be configured for point or line contact to minimise the friction forces; these profiles may be defined by using known methods.

In a preferred embodiment, the timepiece movement further comprises a jumper for positioning the display disc, the jumper being arranged to hold the display disc in a plurality of distinct display positions. In an advantageous variant, a substantially identical tangential gear backlash is provided, when the display disc is in any one of the plurality of distinct display positions, between the two tangentially oriented pins 16*a*, 16*b* and a corresponding tooth 5*a* of toothing 5 which is inserted between the two pins.

In the illustrated example, the drive pinion 22 is coupled through three successive wheels 20*c*, 20*b*, 20*a* to wheel 19 on which the pin wheel engaging wheel 18 is mounted, but it is of course possible to have a different number or arrangement of wheels in driver 6 depending on the features of drive source 8, the gear reduction ratio between the wheels of the train of wheels 20*a*, 20*b*, 20*c*, the display disc dimensions, and the desired additional display function.

Advantages of the embodiments of the invention comprise, among other things: the bidirectionality of the display disc, optimisation of the time during which the display disc remains in a blocked position, a compact mechanism with few parts, and the possibility of incorporating this technology in a modular platform of conventional timepiece movements.

LIST OF REFERENCES

Timepiece movement 2
Date display disc 4
Toothing 5
Tooth 5*a*
Display drive device
Driving means 6
Pin wheel set 10
Axis of rotation A10
Toothed wheel 12
Non-circular profile 13*a*
Pin pinion 14
Pins 16 (pair of pins 16*a* 16*b*)
Engaging wheel 18 (for the pin wheel)
Non-circular profile 13*b*
Axis of rotation A18
Toothed wheel 19
Wheels 20*a*, 20*b*, 20*c*
Additional display wheel (e.g. chronograph wheel) 20*a*
Drive source 8
Drive pinion 22
Electric motor
Additional display hand 24
Limit angle a of a dead angle area (half the angular distance of the area)
T tangential direction
$d_{16}$ distance separating the pair of pins
$d_5$ thickness of one tooth

What is claimed is:

1. A timepiece movement comprising a device for driving an analogue display formed by a display disc including a toothing, the drive device including a drive source and driving means coupling said drive source to the toothing, said drive device including a wheel set including pins, formed of a toothed wheel and of a pinion including pins, and an engaging wheel engaging said toothed wheel, the pin pinion including two diametrically opposite pins separated by a distance configured to position said pins on either side of any tooth of said toothing, wherein said toothed wheel has a first non-circular profile and said engaging wheel has a second non-circular profile which is complementary to the first non-circular profile, and wherein the toothed wheel and the engaging wheel are arranged with respect to each other such that, when said two pins are oriented in a tangential direction to said toothing, said two wheels have a first gear ratio which is lower than a second gear ratio between said wheels when said two pins are in perpendicular alignment to said tangential direction.

2. The timepiece movement according to claim 1, wherein, when said two pins are oriented substantially tangentially to said display disc toothing, said two pins are arranged to define a self-locking system in the event that the timepiece movement is subjected to a shock exerting a tangential force on said toothing.

3. The timepiece movement according to claim 1, wherein the pin pinion is configured with respect to the display disc toothing so as to have a dead angle area for driving the display disc, and wherein the angular distance of the dead angle area is greater than ten degrees.

4. The timepiece movement according to claim 3, wherein, in the event of a shock, said two pins of the pin pinion block the rotation of the display disc when the angular position of the pin pinion is inside the dead angle area.

5. The timepiece movement according to claim 3, wherein a gear reduction ratio between the engaging wheel and the pin wheel set is greater inside the dead angle area than outside said dead angle area.

6. The timepiece movement according to claim 3, wherein at least one additional display wheel of the drive device includes an additional display element, said additional display element being able to operate inside the dead angle area without changing the position of the display disc.

7. The timepiece movement according to claim 6, wherein the additional display wheel is configured to be able to effect a rotation of at least 360° during an angular motion inside the dead angle area.

8. The timepiece movement according to claim 6, wherein the additional display element is a hand mounted on an arbor of the additional display wheel.

9. The timepiece movement according to claim 8, wherein the additional display wheel forms a chronograph mechanism.

10. The timepiece movement according to claim 3, wherein the timepiece movement further comprises a jumper for positioning the display disc, said jumper being arranged to hold the display disc in a plurality of distinct display positions.

11. The timepiece movement according to claim 10, wherein a substantially identical tangential gear backlash is provided, when the display disc is in any one of said plurality of distinct display positions, between said two tangentially oriented pins and a corresponding tooth of said toothing which is inserted between said two pins.

12. The timepiece movement according to claim 1, wherein the drive source is formed by a bidirectional electric motor controlled by an electronic unit of the timepiece movement.

13. The timepiece movement according to claim 1, wherein the display disc is a date ring.

14. The timepiece movement according to claim 6, wherein the drive source is formed by a bidirectional electric motor controlled by an electronic unit of the timepiece movement.

15. The timepiece movement according to claim 6, wherein the display disc is a date ring.

* * * * *